US006133491A

United States Patent [19]

Xing

[11] Patent Number: 6,133,491

[45] Date of Patent: Oct. 17, 2000

[54] PROCESS AND APPARATUS FOR PRODUCING HYDROCARBONS FROM RESIDENTIAL TRASH OR WASTE AND/OR ORGANIC WASTE MATERIALS

[76] Inventor: Li Xing, Zucun Chemical Plant, Fangshan District, Beijing 102403, China

[21] Appl. No.: 09/204,078

[22] Filed: Dec. 3, 1998

[51] Int. Cl.[7] ..... C10G 1/00; C07C 1/00

[52] U.S. Cl. ..... 585/241; 585/240; 585/242; 201/2.5; 201/25

[58] Field of Search ..... 585/241, 240, 585/242; 201/2.5, 25

[56] References Cited

U.S. PATENT DOCUMENTS 5,744,668 4/1998 Zhou et al. ..... 585/241
6,011,187 1/2000 Horizoe et al. ..... 585/241

*Primary Examiner*—Bekir L. Yildirim
*Attorney, Agent, or Firm*—Sughrue, Mion, Zinn, Macpeak & Seas, PLLC

[57] ABSTRACT

The invention provides a process and apparatus for producing hydrocarbons from residential trash or waste and/or organic waste materials. In particular, the invention provides a process and apparatus for producing hydrocarbons from residential trash or waste and/or organic waste materials in virtue of pyrolysis and catalytic cracking.

8 Claims, 1 Drawing Sheet

PROCESS AND APPARATUS FOR PRODUCING HYDROCARBONS FROM RESIDENTIAL TRASH OR WASTE AND/OR ORGANIC WASTE MATERIALS

FIELD OF THE INVENTION

The present invention is directed to a process and apparatus for producing hydrocarbons from residential trash or waste and/or organic waste materials, in particular, to a process and apparatus for producing hydrocarbons from residential trash or waste and/or organic waste materials by pyrolysis and catalytic cracking.

BACKGROUND OF THE INVENTION

With the progress of the society and the improvement of people's life, organic components in residential trash or waste are continuously increasing, and are therefore seriously harmful to the environment. It has become a popular topic in the world to treat residential trash or waste and/or organic waste materials and make them harmless and reused.

The composition of residential trash or waste is very complicated. The burning-process in the prior art is of higher costs. Tail gases resulting from the process pollute the air. Another process in the prior art, the burying-process, occupies many cultivated lands, pollutes water resource under the ground and the materials cannot be reused.

Several technical solutions to these problems have been disclosed in the art. Chambers in U.S. Pat. No. 4,235,676 teaches an apparatus for producing hydrocarbons from waste plastics and industrial and residential waste. Said apparatus comprises a vacuum system and a fixed reactor. The problem to use the apparatus is that production cannot be successively undergone. In addition, the reactor is readily coked, and it is very hard to discharge residues generated from the reaction out of the reactor.

EP-A-0607862 (applicant being Mazda Motor Corporation) discloses a process and apparatus for producing hydrocarbons from waste plastics and waste rubbers. A vertical reactor is used therein. However, this publication does not show how to discharge the residues from the reaction. All the processes stated above cannot simultaneously and successively treat residential trash or waste and/or organic waste materials with a complex composition.

PCT/CN97/00124 filed by the applicant discloses a process and apparatus for producing hydrocarbons from organic and polymeric waste materials. A horizontal rotary reactor is utilized therein. The reactor should be maintained at a high temperature to keep the performance of the reaction of cracking because all reactions are carried out in one reactor. However, the high temperature to be used therein is critical to the quality of the reactor. It is difficult to rotate the reactor if it is made of the normal steel. In this case, the temperature of the reaction should be lowed to keep the reactor in shape. Thus, the reaction of cracking is not complete and the materials cannot be fully decomposed. In addition, the materials are intermittently charged and the residues from the reaction are also intermittently discharged.

The invention is hereby provided to solve these problems in the prior art.

SUMMARY OF THE INVENTION

Accordingly, an object of the invention is to provide a process and apparatus for producing hydrocarbons from residential trash or waste and/or organic waste materials. Particularly, the invention provides a process and apparatus for producing hydrocarbons from residential trash or waste and/or organic waste materials by virtue of two-step cracking at different temperatures with successive feeding and discharging.

According to the invention, the process comprises two steps. The first cracking is performed in the first reactor (horizontal spiral reactor) which is designed in a larger size so that more materials can be treated. The specific size of the reactor depends on the properties of the materials to be treated. For example, the reactor, in general, is designed to be of 1.0–3.0 meters in diameter.

Gaseous components from the first cracking reaction are discharged out of the reactor after the reaction is complete. Resultant residues enter the second reactor (spiral stirring reactor) to undergo the second cracking reaction. The second reactor may be designed in a small size because the volume of the materials has been greatly decreased after the first cracking. The size of the second reactor may be varied depending on the properties of the materials and the condition of the treatment. In general, the second reactor may have a diameter as ½ of the first reactor, such as 0.5–1.5 meters.

Although the temperature to be maintained in the second reactor is much higher than in the first reactor, the second reactor is not readily deformed at such a higher temperature because it is kept stationary and its volume is relatively small. It has no influence on the reaction of cracking even if the second reactor becomes little deformed. The invention, therefore, overcomes the problems in the prior art.

The present invention provides a process for treating residential trash or waste and/or organic waste materials comprising the steps of:

feeding the materials into a horizontal rotary reactor to perform the first cracking reaction; and charging the residues from the first cracking into a spiral stirring reactor to perform the second cracking reaction.

Said process further comprises a step to collect gaseous hydrocarbons from the first and second cracking reactions.

In said process, the materials may be pretreated, if desired.

In said process, the reactions of the first and second cracking comprise pyrolysis and/or catalytic cracking.

Said cracking reaction is carried out at an atmospheric pressure or higher. In general, the cracking is performed at a pressure of 0.02–0.6 MPa. The temperature of the first cracking is maintained at 350–600° C., and that of the second cracking at 600–1200° C. Preferably, the temperature of the first cracking is kept at 400–500° C. and that of the second cracking at 600–800° C.

Catalyst SR-1 is employed in the catalytic cracking.

The invention further provides an apparatus for treating residential trash or waste and/or organic waste materials, which mainly comprises a horizontal rotary reactor and a spiral stirring reactor.

Said horizontal rotary reactor comprises a cylindrical housing; a circular gear wheel, looping on the outer wall of the cylindrical housing; a spiral strip steel, fixed on the inner wall of the cylindrical housing; a feeder, arranged at an end of the horizontal spiral reactor; and the first treatment chamber, installed at another end of the horizontal rotary reactor (terminal end). Said horizontal rotary reactor further comprises a device for internal heating.

Said feeder comprises a screw feeder or a reciprocating feeder.

Said spiral stirring reactor comprises a cylindrical housing, one end of which is connected with the first treatment chamber; a spiral stirrer, installed in the cylindrical housing; the second treatment chamber, arranged at another end of the cylindrical housing; and a spiral drainer, installed at the bottom of the second treatment chamber.

A fixed bed is installed in the interior upper part of said first and second chambers respectively.

The apparatus according to the invention, if desired, further comprises a pretreatment device, by which the moisture in the materials can be removed.

The pretreatment device may be designed a shape like the first reactor. The temperature therein may be maintained by hot gases and is not needed as high as in the first reactor.

The apparatus according to the invention further comprises a device for collecting hydrocarbons, which may be a conventional device for separating oil and water in the art. For example, it may include a condenser, a tank for collecting hydrocarbons and a water-sealed tank.

DETAILED DESCRIPTION OF THE INVENTION

Figure 1:
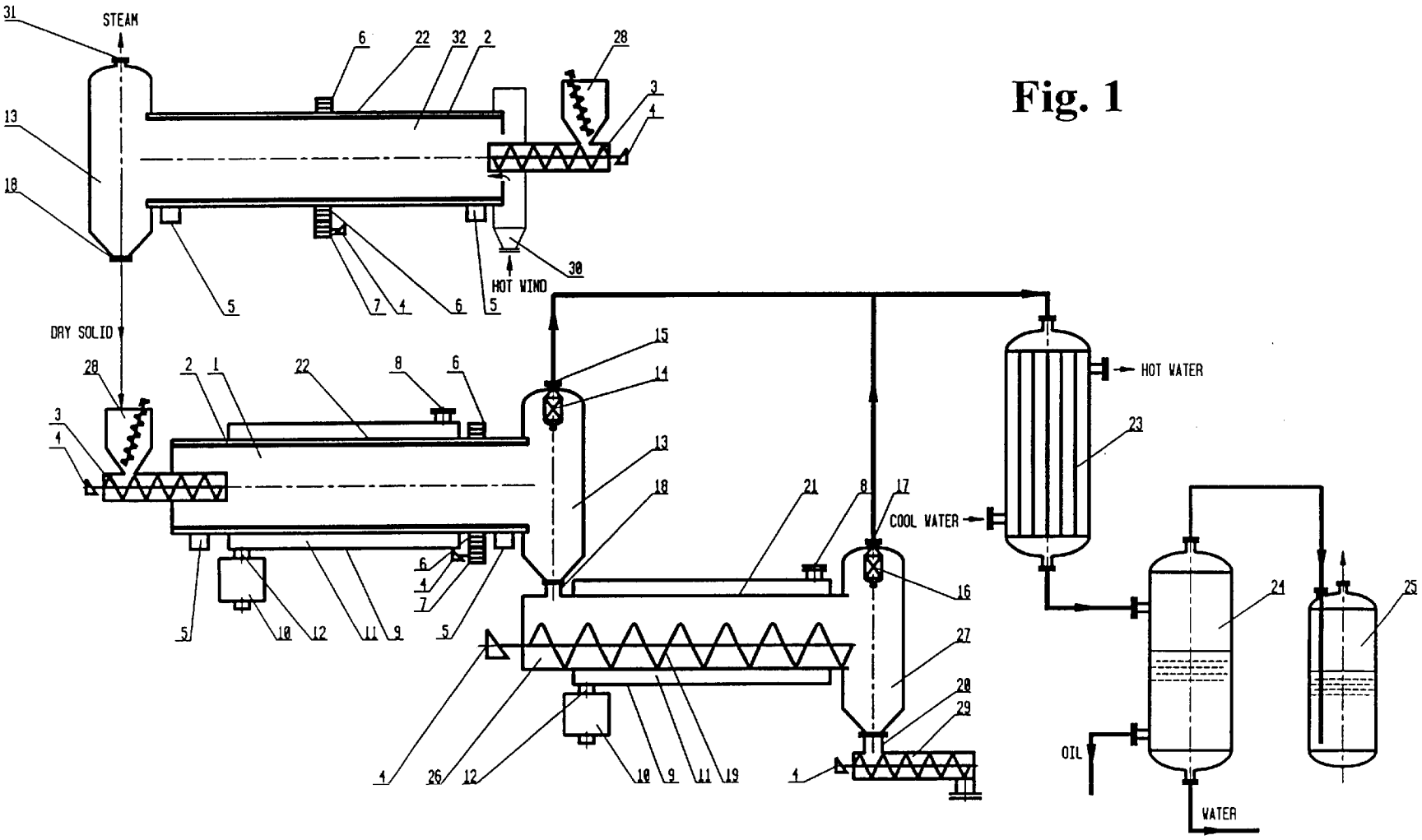
FIG. 1 is a schematic view of a preferred embodiment of the apparatus according to the invention.

According to the process of the invention, the residential trash or waste and/or organic waste materials, pretreated or not are successively introduced into a sealed horizontal rotary reactor by a screw feeder. The reactor is driven to rotate and heated, and the first cracking is carried out therein. Gaseous hydrocarbons resulting from the reaction is drained out of the reactor. At the same time, resultant residues, which have not been decomposed completely in the reaction, are successively charged into an other sealed spiral stirring reactor. The spiral stirring reactor is heated and a screw stirrer therein is electrically driven to rotate continuously. The second cracking is carried out in the spiral stirring reactor at a high temperature to fully decompose organic components in the residues from the first cracking. Meanwhile, inorganic residues resulting from the second cracking are successively discharged out of the spiral stirring reactor. Gaseous hydrocarbons from the second cracking are drained out of the reactor and collected.

In said process, both the first and second cracking comprise a pyrolysis reaction and/or a catalytic cracking. Pyrolysis may be carried out alone if no catalytic cracking is needed. Catalytic cracking undergoes in the fixed bed installed inside the reactors. Heat needed in the catalytic cracking is supplied by the reactors themselves. The catalyst may not be carried in the fixed bed if no catalytic cracking for the materials is needed. The cracking is carried out at an atmospheric pressure or higher. In general, the cracking is performed at a pressure of 0.02–0.6 MPa. The temperature of the first catalytic cracking is maintained at 350–600° C., and that of the second catalytic cracking at 600–1200° C. Preferably, the temperature of the first catalytic cracking is kept at 400–500° C. and that of the second catalytic cracking at 600–800° C. The catalyst used in the invention is selected from catalyst SR-1, which comprises 5% CHO-1 (commercial name, produced by Qilu Petroleum & Chemical Co., China), 20% REY, 30% mercerized zeolite and 45% catalyst ZSM-5, by weight.

The apparatus of the invention mainly comprises a horizontal spiral reactor, a spiral stirring reactor and a device for collecting hydrocarbons.

Said horizontal rotary reactor comprises a cylindrical housing, supported thereunder by several groups of circular brackets (two each group) on the ground under the housing for rotating clockwise or counter-clockwise; a circular gear wheel, looping on the outer wall of the cylindrical housing and connected therewith or fixed thereto by means of welding or a binder bolt to drive the housing to synchronously rotate; a spiral strip steel, fixed on the inner wall of the cylindrical housing like a female screw; a feeder, arranged at an end of the horizontal spiral reactor, the stationary outer wall of which is connected with the rotated housing of the reactor by virtue of a mechanically sealing method and other sealing methods in the art; and the first treatment chamber, installed at another end of the horizontal spiral reactor, which is stationary and connected with the rotated housing by means of a mechanical seal or other sealing methods in the art; and a fixed bed, vertically installed at the upper inside said first treatment chambers and connected with an outlet of the reactor for discharging gaseous products.

Said spiral stirring reactor comprises a cylindrical housing, fixed on the ground and connected with an inlet for the materials at the upper of one end thereof; a second treatment chamber, arranged at another end of the cylindrical housing; a fixed bed, vertically arranged at the upper inside the second treatment chamber and connected with an outlet of gaseous products; a spiral stirrer, installed in the cylindrical housing and driven by a governor motor; a spiral drainer, installed at the bottom of the second treatment chamber, wherein an outlet for the residues in the second treatment chamber is connected with an inlet for the materials in the spiral drainer.

Said device for collecting hydrocarbons may be a conventional device for separating oil and water in the art. For example, it may include a condenser, a hydrocarbons-collecting tank and a water-sealed tank.

A preferred embodiment of the process of the invention comprises grounding the residential trash or waste and/or organic waste materials to be of a diameter below 35 centimeters; charging resultant materials into the sealed horizontal spiral reactor; rotating and heating the horizontal rotary reactor to perform the first cracking; introducing the residues from the first cracking into the sealed spiral stirring reactor to undergo the second cracking, while draining gaseous substances resulting from the first cracking out of the horizontal rotary reactor away; and collecting gaseous hydrocarbons produced from the first and second crackings in virtue of the conventional means. The residues from the second cracking have been completely decomposed, and contain, therefore, no organic components. The residues are ground, magnetically selected and separated to obtain industrial fillers and waste metals.

In the above process, the cracking comprises pyrolysis and/or catalytic cracking. Only pyrolysis proceeds if the materials such as the residential trash or waste contain less organic components. Both pyrolysis and catalytic cracking proceed when the materials contain a lot of polymeric substances such as waste plastics, waste rubbers and waste oils, and the like.

The catalytic cracking is carried out in the fixed bed installed in the reactors. Heat needed for the catalytic cracking is supplied by that inside the reactor. The temperature of the first cracking is kept at 350–600° C. and that of the second cracking at 600–1200° C. The actual temperature depends on the properties of the materials to be treated. The catalyst selected from SR-1 is carried on the fixed bed. The catalyst SR-1 comprises 5% CHO-1, 20% REY, 30% mercerized zeolite (molar proportion between Si and A1 being 12:1) and 45% ZMS-5. It is produced by fully mixing all the above components.

The reactions can be carried out at the atmospheric pressure or higher. The gaseous products resulting from the first and second crackings are sequentially condensed and separated to get hydrocarbons with different fractional cuts and combustible gases by the conventional manner. The inorganic residues resulting from the second cracking are discharged out of the spiral stirring reactor. They are ground and magnetically selected to obtain inorganic fillers in industry and waste metals.

The materials of residential trash or waste and/or organic waste materials to be treated in the process of the invention comprise residential trash or waste, waste products, waste plastics, waste rubbers including waste tires, sludge, human or animal excrements, woodflours, crude oils, waste oils, heavy oils and any other materials containing organic or polymeric components.

A preferred embodiment of the apparatus of the invention comprises the horizontal spiral reactor, the spiral stirring reactor and the device for collecting hydrocarbons.

The horizontal rotary reactor comprises a cylindrical housing, supported thereunder by several groups of circular brackets (two each group) on the ground for clockwise or counter-clockwise. A thermal insulation is positioned around the housing. A heating layer is situated between the housing and the stationary thermal insulation. Flue gases at a high temperature enter the thermal insulation to heat the housing from one end of the heating layer and are drained away from another end thereof. The horizontal rotary reactor may be designed as an inner-heating style. For example, pipelines for flue gases may be fixed at the middle of the reactor. The temperature needed in the reactor can be kept with the flue gases through the pipelines. In this case, only the thermal insulation is needed and the heating layer can be omitted. The spiral strip steel is fixed to the inner wall of the housing like a female screw, which can drive the materials in the reactor forwards or backwards when the housing is rotated. One end of the housing is connected with a screw feeder or a reciprocating feeder, and another end thereof is connected with the first treatment chamber. The mechanical seal or other sealing manner in the art is used to connect the rotary housing with the stationary screw feeder, the first treatment chamber and the thermal insulation, respectively. The fixed bed is installed at the upper inside the first chamber. The gaseous products resulting from pyrolysis are drained out of the reactor away through the fixed bed.

Said spiral stirring reactor comprises a cylindrical housing, fixed on the ground. A rotary spiral stirrer is arranged in the housing. Two ends of the housing are respectively connected with an inlet of the residues from the first cracking and the second treatment chamber. A heating layer, which is embraced by a thermal insulation, is positioned over the housing. An inlet and an outlet of the flue gas for heating the housing are designed at two ends of the heating layer. The gaseous products resulting from pyrolysis enter the fixed bed installed at the upper in the second treatment chamber to perform catalytic cracking. Resulting gaseous hydrocarbons therefrom then are drained out of the reactor away via an outlet connected with the fixed bed.

The invention is further described with of help of the Drawings as follows.

According to the invention, the apparatus, referred to FIG. 1, comprises a horizontal rotary reactor 1, a spiral stirring reactor 26 and a device for collecting hydrocarbons including a condenser 23, a hydrocarbons-collecting tank 24 and a water-sealed tank 25.

The apparatus of the invention further comprises a pretreatment device 32, if necessary.

Horizontal rotary reactor 1 comprises a cylindrical housing 22, supported thereunder on the ground by several groups of circular brackets 5 (two each group) for making the housing rotate flexibly. A circular gear wheel 6, with the same diameter as the outer layer of the housing 22, is fixed to the outer wall of the housing 22. Gear wheel 6 is gripped by a small gear wheel 7 driven by a governor motor 4. Gear wheel 6 rotates accomanying small gear wheel 7 by driving governor motor 4 to rotate, and thereby the housing is driven to synchronously rotate therewith. A heating layer 11, embraced by a stationary thermal insulation 9, is located around the housing. Flue gases for heating the housing enter the heating layer 11 from one end thereof and are drained away via another end thereof. Alternatively, pipelines for flue gases may be installed at the middle of the reactor (not shown in the FIG.). The temperature needed for the reaction in the reactor is kept with flue gas through the pipeline. In this case, the heating layer is not needed. The inner wall of the housing 22 is homogeneously distributed by a spiral strip steel 2 like a female screw. When the housing 22 is rotated clockwise or counter-clockwise, the materials in the reactor are driven thereby to move forwards or backwards. One end of the housing is connected with a screw stirrer (a reciprocating stirrer) 3 and the other end thereof connected with the first treatment chamber 13. The mechanical seal or other seal manner in the art is used to connect the rotary housing 22 with the stationary screw feeder 3, first treatment chamber 13 and thermal insulation 9, respectively. A fixed bed 14 is vertically installed at the upper inside first treatment chamber 13 and connected with an outlet 15 for discharging gaseous products resulting from the cracking. The gaseous products enter a tank for collecting hydrocarbons 24 via a condenser 23. The gases not being condensed are introduced into a water-sealed tank 25 and discharged from the top thereof. Resulting residues from horizontal rotary reactor 1 directly enter an inlet 18 of a spiral stirring reactor 26 through the first treatment chamber 13. Spiral stirring reactor 26 comprises a cylindrical housing 21 fixed to the ground. Two ends of the housing 21 are respectively connected with an inlet 18 for the feedings and the second treatment chamber 27. A screw stirrer 19 driven by a governor motor 4 is installed in the housing 21. A heating layer 11, embraced by a stationary thermal insulation 9, is located around the housing 21. An inlet 12 and an outlet 8 of flue gases at a high temperature for heating the housing 21 are arranged at two ends of the heating layer 11. Gaseous hydrocarbons resulting from the second cracking are drained out of the reactor away via a fixed bed 16. The gaseous products enter a tank for collecting hydrocarbons 24 via a condenser 23. The gases not being condensed are introduced into a water-sealed tank 25 and discharged from the top thereof.

The apparatus of the invention further comprises a pretreatment device 32 when water-containing materials are to be treated. The device 32 may be designed to be similar to the first reactor, as shown in FIG. 1. The same reference numeral therein represents the same element as in the first reactor, provided that the temperature in the device 32 can be maintained at 100–200 C. and the materials heated by means of directly contacting a hot wind. Reference numerals 30 and 31 represent an inlet and an outlet of the hot wind, respectively.

The process of the invention will be further explained in combination with FIG. 1.

The residential trash or waste and/or organic waste materials are ground to be a piece with a diameter below 35 centimeters. The resultants then are charged into a hopper 28. If the materials are fluid, they may be pumped into hopper 28. The materials are driven by screw feeder 3 to enter horizontal rotary reactor 1. Flue gases of high temperature from heating furnace 10 supply the reactor 1 with heat needed therein via heating layer 11. Gear wheel 6 is driven by small gear wheel 7, which is driven by a governor motor, thereby circular housing 22 is synchronously rotated. The materials in the reactor move forwards under the action of spiral strip steel 2 installed in the inner wall of the reactor. Governor motor 4 can be regulated to rotate clockwise or counter-clockwise so that the reactor 1 may synchronously rotate. The materials in the reactor 1 are heated to perform a pyrolysis reaction and the residues resulting therefrom fall into spiral stirring reactor 26 through the first treatment chamber. Gaseous hydrocarbons from the reaction enter fixed bed 14 to perform catalytic cracking. The catalytic cracking is not carried out if no catalyst is carried in the fixed bed. Gaseous hydrocarbons generated from the reaction enter a condenser 23 via an outlet of the reactor, then enter a tank 24 for collecting hydrocarbons. The collected hydrocarbons may be fractionalized to be gasoline, diesel and heavy oil. The heavy oil can be returned to the reactor 1 to perform cracking or sold as a fuel. Gases not being condensed can be introduced back to the furnace 10 to burn after they enter water-sealed tank 25. The reactor 1 according to the invention has significant advantages such as quick reaction, high efficiency of heat transfer, unlikeness of materials' being coked and successive production process. To meet the requirements of the industry, the reactor 1 should be designed as large as possible. However, the larger the reactor is, the more readily the reactor deforms at a high temperature. Thus, the reactor is hard to rotate. Therefore, it is desirable to undergo the first cracking at a relatively low temperature. The problem resulting therefrom is that the cracking reaction is not complete at such a low temperature and organic components in the materials are not thoroughly decomposed.

To solve the problems, residues from the reactor 1 are introduced into spiral stirring reactor 26 to undergo further second cracking at a higher temperature. Flue gases of high temperature from burning furnace 10 supply the reactor 26 with heat through heating layer 11. Screw stirrer 19 in the reactor 26 is driven to rotate by governor motor 4. The second cracking of the residues from the reactor 1 proceeds at a higher temperature. The amount of the materials significantly decreases after the first cracking. The reactor 26 therefore is designed to be of a smaller volume. The reactor 26 is not readily deformed at a higher temperature because the reactor is of the small volume and arranged stationary. Even though the reactor 26 is slightly deformed it has no influence on the second cracking, provided that it does not effect the rotation of the screw stirrer. Organic components in the materials are completely decomposed to gaseous hydrocarbons during the second cracking. Resultant gaseous hydrocarbons enter the fixed bed 16 to perform catalytic cracking. The resultant hydrocarbons drained out of the reactor 26 enter the condenser 23, and then reach the tank 24 for collecting hydrocarbons. Gases not being condensed are introduced back into the burning furnace 1 to burn after they enter the water-sealed tank 25. The residues resulting from the second cracking contain no organic components. They are drained out of the reactor 26 by spiral drainer 29 installed at the bottom of the second treatment chamber 27, and are ground, magnetically selected and separated to obtain industrial materials such as inorganic fillers, waste metals and the like.

The following examples are presented in order to better communicate the invention. The examples are not intended to limit the scope of the invention in any way.

EXAMPLE 1

Resident wastes in winter from Beijing were ground into pieces with a diameter below 35 centimeters. After pretreated (dehydrated), the materials were charged into the hopper 28 and entered the reactor 1 by virtue of the screw feeder 3. A desired amount of the catalyst SR-1 was carried in the fixed bed 14 in the reactor 1. The reactor 1 was heated by flue gases of high temperature from the burning furnace 10 via the heating layer 11 and driven to rotate. The materials were heated to perform the first cracking including pyrolysis and catalytic cracking in the reactor 1. The cracking was carried out at a temperature of 400–500° C. under a pressure of 0.02–0.3 MPa. Gaseous hydrocarbons produced from the cracking were drained out of the reactor 1 and entered the hydrocarbons-collecting tank 24 for generating hydrocarbon oils with a low boiling point via the condenser 23. Combustible gases not being condensed such as $H_2$ and hydrocarbons $C_1$–$C_4$ were introduced back into the burning furnace 10 to burn through the water-sealed tank 25. The residues resulting from the first cracking felt into the reactor 26 through the bottom of the first treatment chamber 13 to perform the second cracking at a higher temperature. Heat needed therein was supplied with flue gases produced from the burning furnace 10. The second cracking was carried out at a temperature of 600–800° C. under a pressure of 0.02–0.3 MPa. Gaseous products produced from pyrolysis reaction of the second cracking went up into the fixed bed 26 installed at the upper of the reactor 26 to undergo catalytic cracking with the catalyst SR-1. Heat needed for the cracking was maintained by the reactor itself. Residues from the second cracking were discharged into the second treatment chamber 27 and drained out of the reactor 26 away by the spiral drainer 29 at the bottom the chamber 27. Gaseous hydrocarbons resulting from the second cracking were introduced into the condenser 23 and then entered the tank 24 to get hydrocarbon oils with low boiling points. The collected hydrocarbon oils from the first and second cracking were further fractionalized, if desired.

Analysis for the materials and products were given as follows.

Materials (by weight): volatiles 78%, fixed carbon 13.9%, ash 10.1%

Elementary analysis for the materials: H 5.6%, C 53.1%, N 8.8%, O 21.8%, S 0.6%.

Products (by weight): hydrocarbons 28%, gas (hydrocarbons) 35%, inorganic substances and metals 16%, moisture 21%.

EXAMPLE 2

Waste tires were treated in the same manner as in Example 1 except that the pretreatment of the materials was not needed. The condition of the treatment and the result thereof were given as follows.

Materials: tires 1000 kg

Condition:

Temperature of the first cracking: 450–600° C.

Pressure of the first cracking: 0.08–0.4 MPa

Catalyst for the first cracking: SR-1

Temperature of the second cracking: 750–850° C.

Pressure of the second cracking: 0.08–0.4 MPa

Catalyst for the second cracking: SR-1

Products:

Gasoline 98 kg (RON 93.5); Diesel 432 kg (cetane number 59, Freezing Point<−20° C.);

Combustible Gases ($H_2$, $C_1$–$C_4$) 90 kg; Steel Wire 60 kg; Carbon Black 320 kg (organic content<0.1%).

What I claim is:

1. A process for producing hydrocarbons from residential trash or waste and/or organic waste materials, comprising the steps of:

feeding the materials into a horizontal rotary reactor to perform the first cracking reaction; and charging the residues from the first cracking into a spiral stirring reactor to perform the second cracking reaction.

2. The process according to claim 1, wherein the cracking reaction comprises a pyrolysis reaction and/or a catalytic cracking.

3. The process according to claim 1, wherein said process further comprises a step of collecting hydrocarbons resulting from the reaction.

4. The process according to claim 1, wherein said process further comprises a step of pre-treating the materials to remove moisture therein.

5. The process according to claim 1, wherein the first cracking proceeds at a temperature of 350–600° C., and the second cracking proceeds at a temperature of 600–1200° C.

6. The process according to claim 5, wherein the first cracking proceeds at a temperature of 400–500° C., and the second cracking proceeds at a temperature of 600–800° C.

7. The process according to claim 2, wherein the catalytic cracking proceeds in the presence of catalyst SR-1.

8. The process according to claim 5 or 6, wherein the cracking reaction proceeds under a pressure of 0.02–0.6 MPa.

* * * * *